United States Patent [19]

Gettig et al.

[11] Patent Number: 4,963,102

[45] Date of Patent: Oct. 16, 1990

[54] ELECTRICAL CONNECTOR OF THE HERMAPHRODITIC TYPE

[75] Inventors: William A. Gettig; Larry E. Shook, both of Millheim, Pa.

[73] Assignee: Gettig Technologies, Spring Mills, Pa.

[21] Appl. No.: 472,271

[22] Filed: Jan. 30, 1990

[51] Int. Cl.[5] ..... H01R 13/28

[52] U.S. Cl. ..... 439/291; 439/295; 439/595

[58] Field of Search ..... 439/287, 290–293, 439/295, 595, 723

[56] References Cited

U.S. PATENT DOCUMENTS

| | | | |
|---|---|---|---|
| 3,011,143 | 11/1961 | Dean | 439/291 |
| 3,157,448 | 11/1964 | Crimmins et al. | 439/295 |
| 3,178,669 | 4/1965 | Roberts | 439/291 |
| 3,337,836 | 8/1967 | Churla, Jr. | 439/295 |
| 3,634,811 | 1/1972 | Teagno et al. | 439/290 |
| 4,061,406 | 12/1977 | Kunkle | 439/291 |
| 4,552,425 | 11/1985 | Billman | 439/295 |
| 4,753,613 | 6/1988 | Morgan | 439/291 |

FOREIGN PATENT DOCUMENTS

| | | | |
|---|---|---|---|
| 2405464 | 8/1974 | Fed. Rep. of Germany | 439/291 |

*Primary Examiner*—Paula A. Bradley

*Attorney, Agent, or Firm*—Richard C. Litman

[57] ABSTRACT

A hermaphroditic connector for use in pairs to join a plurality of electrical conductors includes a block housing of integral construction containing one or more stacked rows of a plurality of adjacent isolated passageways. A horizontal shelf extends forwardly from each such row and includes an inner shelf surface having a front nose projecting forward of the housing side walls. Each passageway is adapted to receive a conductor terminal having a planar tongue with adjacent lateral tangs and an integral, abutting spring arm. During insertion of each terminal into any one passageway, the tangs engage within lateral passageway slots and the spring arm is juxtapositioned the shelf inner surface with a lug on the terminal blade deflecting and becoming entrapped by a lock finger in the housing. Proper alignment and positive juncture between an opposed, inverted pair of the connectors is achieved in view of pairs of laterally spaced apart tongues projecting forwardly from the front face and which overlap opposed ones of the tongues to insure that continued closing wil cause opposed shelves to be immediately juxtaposed one another. The resultant closure insures that each terminal tongue slidably contacts an opposed terminal tongue, intermediate its tongue and spring arm. Mating locking and catch members on each connector complete the connection of the housings.

10 Claims, 2 Drawing Sheets

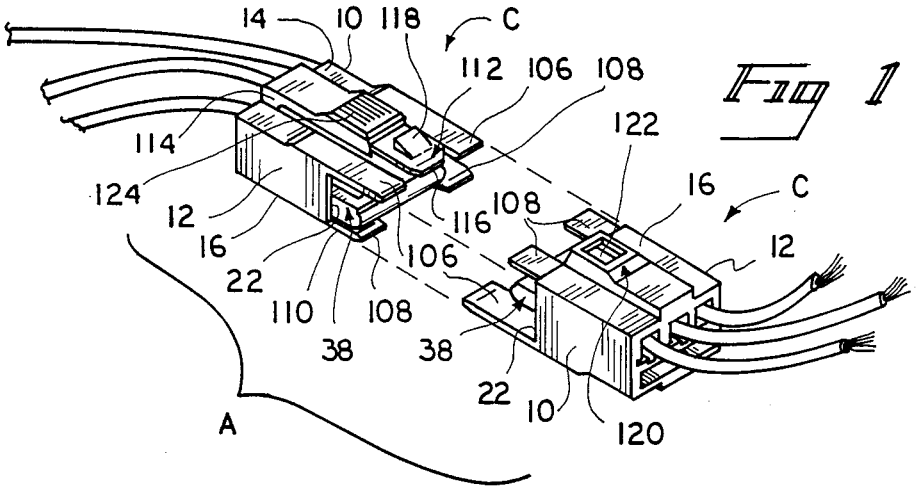
Fig 1
Fig 2
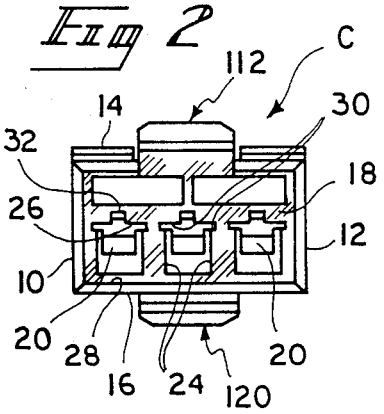
Fig 3
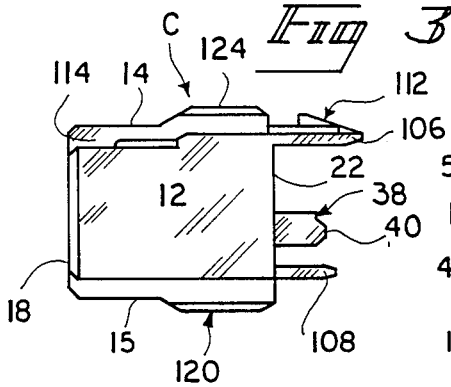
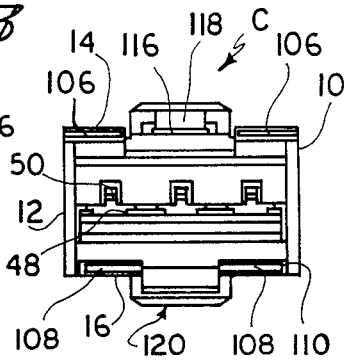
Fig 4
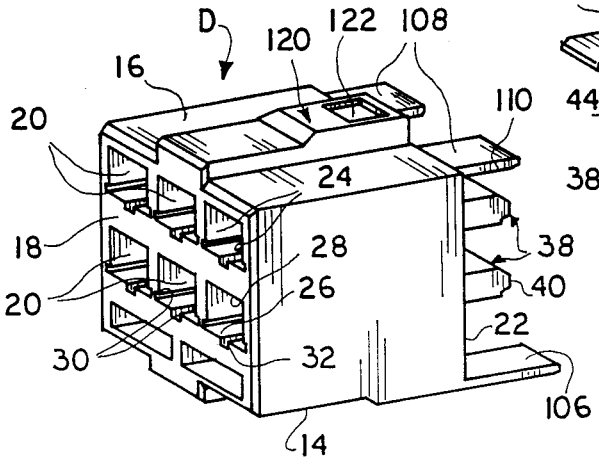
Fig 5
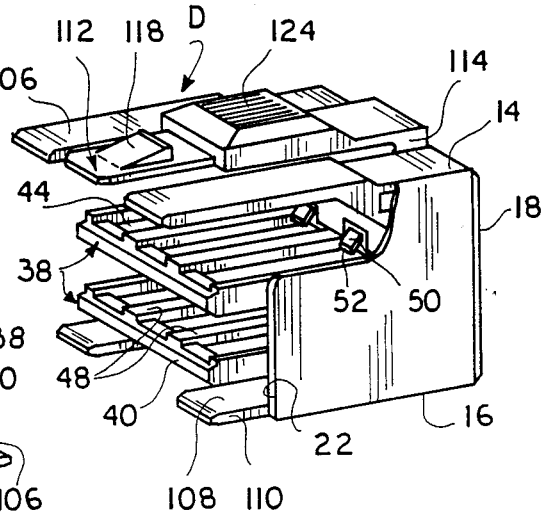
Fig 6

ELECTRICAL CONNECTOR OF THE HERMAPHRODITIC TYPE

FIELD OF THE INVENTION

This invention relates generally, to electrical connectors and more particularly, to an improved connector for joining conductors in series and which includes a hermaphroditic housing utilized in pairs to provide a quick, positive and readily releasable connection.

BACKGROUND OF THE INVENTION

Electrical apparatus of various types often call for the provision of ready means allowing for the convenient, simultaneous connection and disconnection of a plurality of conductors in series. Automotive vehicles represent a typical environment wherein it is desired to provide for the quick assembly of a plurality of conductors in series. As is well known, today's automobiles employ a rather sophisticated electrical system containing many wiring harnesses involving hundreds of circuits transmitted throughout the engine compartment, the vehicle interior and the trunk. To facilitate not only the initial assembly of the vehicle but also to accommodate subsequent repair, testing and replacement, it is imperative that releasable connectors be utilized throughout the numerous involved wiring harnesses. With the influx of computer controlled systems it becomes necessary to allow for the in-line insertion of electronic instruments for checking the digital circuits, not only in vehicles but a myriad of various apparatus.

Connectors according to the present category should lend themselves to fabrication in various configurations in order to accommodate multi-pole installations covering a wide range of numbers of conductors. Thus, the same basic construction should lend itself to the formation of a connector housing containing a single row of two or more conductor terminations or, a plurality of stacked rows each presenting numerous conductor terminations. It is most desirable that an improved conductor termination be provided, not only to insure the highest possible amperage rating but also to permit quick and positive insertion and retention of the terminations within the connector housing. When two such connector housings are secured together it is also important that the engagement between the respective pairs of series terminations defines the most reliable and effective mechanical and electrical juncture.

DESCRIPTION OF THE RELATED ART

Numerous examples exist of hermaphroditic connectors, as such devices provide convenient means for the quick and simultaneous joining and disconnection of a plurality of electrical conductors. The advantages of utilizing identical or hermaphroditic connector elements for the two components of each desired juncture will be obvious from the manufacturing, sales and use standpoint. Prior art examples of such connectors will be found in Johnson U.S. Pat. No. 3,676,833 , Yamada et al U.S. Pat. No. 3,688,243 and Fairbairn et al U.S. Pat. No. 3,827,007. These patented connectors involve hermaphroditic members, each receiving snap-fitted conductor terminals and which are joined in a mating relationship upon inverting one of a pair of the connector members. Crimp type conductor terminals per se, which comprise a unitary member folded to provide a blade or tongue portion having an overlying deflectable portion will be found in Brewer U.S. Pat. No. 2,326,327 and Evans et al U.S. Pat. No. 3,208,030. Although these patents relate to connectors and terminals generally akin to the instant development, the specific construction and operation of the present invention presents a unique, improved hermaphroditic connector not obvious from the above referenced devices.

SUMMARY OF THE INVENTION

By the present invention, an improved hermaphroditic connector is provided and which is utilized in pairs to produce electrical continuity between a plurality of conductors and terminals mounted within the two connector housings. The connector comprises a block-like configuration of monolithic construction, presenting one or more stacked rows of adjacent terminal passageways or enclosures. These passageways axially extend through the rear area of the connector with all passageways of each row communicating with a single transverse coextensive shelf or ledge having a forward edge that projects beyond the side walls of the connector. These passageways and shelves are constructed to cooperate in a particular manner with individual conductor terminals such that when inserted into any passageway, a terminal is specifically oriented and ultimately locked in place as a terminal lug becomes permanently captured by a deflectable finger integrally formed within the connector.

The terminals are likewise formed as an integral member and include a planar primary tongue adjacent pairs of conductor and wire crimp ears with wider, laterally projecting tangs intermediate the two pairs of crimp ears. At the rear of the terminal, the material thereof is folded forwardly and terminates in an undulating spring arm.

The aforementioned terminal lateral tangs provide guidance and control as they cooperate with lateral slots or grooves associated with each connector passageway. During terminal insertion, the terminal spring arms are disposed adjacent an inner surface formed on one face of the connector shelves and which controls deflection of the spring arms and adjacent tongues both when inserted into the housing and during the intermeshing of terminals. In this manner, the tongues are all critically spaced from the respective shelves so that when two such connectors are axially joined, opposed shelves overlie one another in juxtaposition and opposed ones of the terminal tongues are moved into engagement in a sliding, planar manner with joined terminal tongues, each being sandwiched between the tongue and spring arm of the cooperating terminal.

The initial juncture between two cooperating connectors is achieved by the overlapping of laterally spaced apart pairs of top and bottom connector housing tongues, all of which extend beyond the plane of the connector shelves and present the forwardmost portion of the connector. Positive locking together of two joined connectors is achieved by means of a resilient tab containing a ramp lock and which snap fits within a socket catch likewise formed on each connector.

In joining together a pair of the subject connectors, a user readily orients two such connectors by insuring that the ramp lock of one member is uppermost while the socket catch of the other is uppermost.

Accordingly, one of the objects of the present invention is to provide an improved hermaphroditic connector including one or more rows of conductor passageways with each row provided with a shelf defining guidance and alignment of conductor terminals mounted within the connector.

Another object of the present invention is to provide an improved hermaphroditic connector having isolated conductor passageways adjacent its rear wall and which communicate with a terminal supporting shelf extending forwardly of the side walls of the connector such that the corresponding shelf of a cooperating connector opposingly overlies the shelf to provide a sliding, mating engagement between conductor terminals mounted in the respective connectors.

A further object of the present invention is to provide an improved hermaphroditic connector for a plurality of conductor terminals, having pairs of laterally spaced apart top and bottom tongues projecting from the front thereof to provide positive alignment between two opposed and relatively inverted ones of the same connector and including a cantilever lock tab intermediate the top tabs engageable within a catch socket provided on the bottom wall of each connector.

Still another object of the present invention is to provide an improved hermaphroditic connector including conductor terminals having a planar tongue provided with wider, lateral tangs engageable within passageway grooves in the connector and wherein a spring arm on each of the terminals engages a shelf inner surface on the connector to maintain the terminal tongues in a position spaced from the shelf to permit identical terminals on cooperating connectors to slidably engage with the respective terminal tongues and arms sandwiched between each other.

Another object of the present invention is to provide an improved hermaphroditic connector including a plurality of forwardly extending tongues with one intermediate locking tab which, when two opposed such connectors are moved to one another, combine with at least one foreshortened projecting shelf, to provide both lateral and vertical alignment of the two connectors to insure a mating engagement between a plurality of conductor terminals mounted within the connectors.

Still another object of the present invention is to provide an improved hermaphroditic connector of unitary, molded construction including a plurality of laterally and vertically isolated conductor terminals each having an integral lug engageable with a deflectable locking finger formed as an integral portion of the connector.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

FIG. 1 is an exploded perspectively view of a pair of connector housings according to the present invention;

FIG. 2 is a rear end elevation of one of the connectors of FIG. 1;

FIG. 3 is a side elevation of the connector of FIG. 2;

FIG. 4 is a front end elevation of the connector of FIG. 2;

FIG. 5 is a rear perspective view of a modified embodiment of the connectors shown in FIG. 1;

FIG. 6 is an inverted front perspective view of the connector of FIG. 5 with portions broken away;

Similar reference characters designate corresponding parts throughout the several figures of the drawings.

DESCRIPTION OF THE PREFERRED EMBODIMENT

Figure 7:
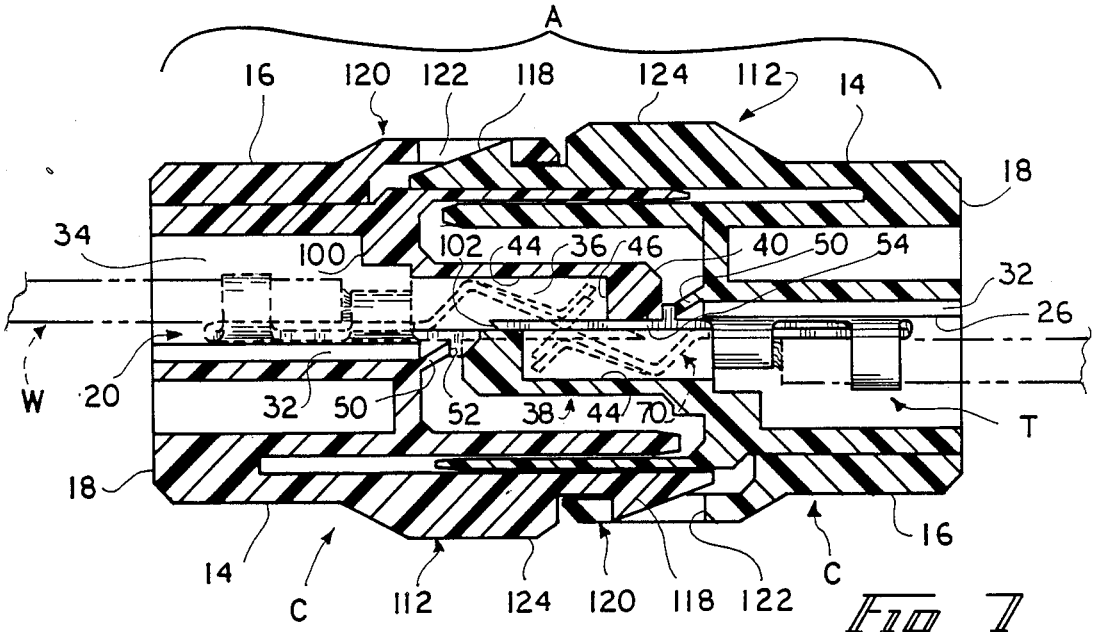
FIG. 7 is an enlarged vertical sectional view of two connector housings of FIGS. 1-4 shown in the united and locked condition with the inclusion of engaged conductors and terminals.

Referring now to the drawings, particularly FIG. 1, the present invention will be seen to relate to a connector assembly A comprising the juncture of a pair of hermaphroditic connectors or housings C,C each comprising a molded, one-piece construction, being fabricated of any suitable well known insulative material. In view of the identical, dual male-female construction of any connector embodiment according to the instant invention, it follows that the detailed description of one will apply to the other.

The embodiment depicted in FIGS. 1–4 and 7 relates to a connector C comprising a block-like housing having opposite, planar, vertical side walls or partitions 10,12 bounded by horizontal top and bottom walls 14,16 respectively and an end or rear wall 18. The body of the connector housing includes at least one horizontal row of a plurality of laterally adjacent wire or conductor/-terminal passageways 20, each of which is radially bounded by a plurality of walls defining a passageway that axially extends from connector rear wall 18, to a point disposed forward of the front edges 22 of the housing side walls 10,12.

The generally rectangular cross-sectional configuration of each passageway rear portion 34 is defined by a pair of vertical side walls 24,24 and intersecting first and second, horizontal walls 26,28 as shown most clearly in FIGS. 2 and 5. Extending laterally of each horizontal wall 26 are a pair of opposed grooves or slots 30,30 formed in the vertical walls 24,24 immediately adjacent the first horizontal wall 26, while a central slot 32 is provided in the first horizontal wall 26. The purpose of these slots will become apparent hereinafter.

From the cross-sectional view of FIG. 7, the conductor/terminal passageways 20 will be seen to comprise enlarged, fully isolated rear portions 34 extending forwardly from the connector rear wall 18 and which communicate with respective front portions 36 of lesser cross-sectional areas. The front portions 36 for all passageways 20 in any one horizontal row are formed by a single planar shelf 38 having a forward nose or edge 40 which will be seen to extend well forward of the vertically disposed front edges 22 of the connector side walls 10,12. An inner shelf surface 44 is provided on the face of each shelf 38 opposed to the associated passageway first wall 26 and will be seen to terminate at a rearwardly facing wall 46 behind the shelf nose 40. Ridges or fences 48 project normal from the shelf surface 44 to provide a barrier laterally separating each passageway 20 of each row thereof.

Locking means are provided to insure a positive retention of conductor terminals inserted into the respective passageways 20. As shown most clearly in FIGS. 4,6 and 7, an inclined, deflectable terminal lock finger 50 extends from the forward edge of the first horizontal wall 26 of each passageway rear portion 34 and includes a substantially vertically disposed front edge 52 axially aligned with the adjacent slot 32.

With the above connector structure in mind, the details of the related conductor terminal T may now be described, with particular reference being made to FIG. 8 of the drawings. The terminal T will be understood to be formed of an integral piece of any suitable conductive, spring metal and includes a primary blade or tongue 54 extending the full length of the terminal and which terminates in a forward nose 56 having a chamfer or bevel 58 on its upper surface 60 and corner tapered portions 62,62. The rear of the primary blade 54 will be seen to be folded, as at 64 and from which extends a secondary blade 66. This secondary blade is of a width less than that of the adjacent primary blade 54 and includes a rear portion 68 flushly engaging the rear of the primary blade upper surface 60. The forward portion of the secondary blade is configured to provide an undulating spring arm 70 comprising three angularly offset portions 72,74,76 which form an intermediate outer bend 78 and an inner bend 80.

Figure 8:
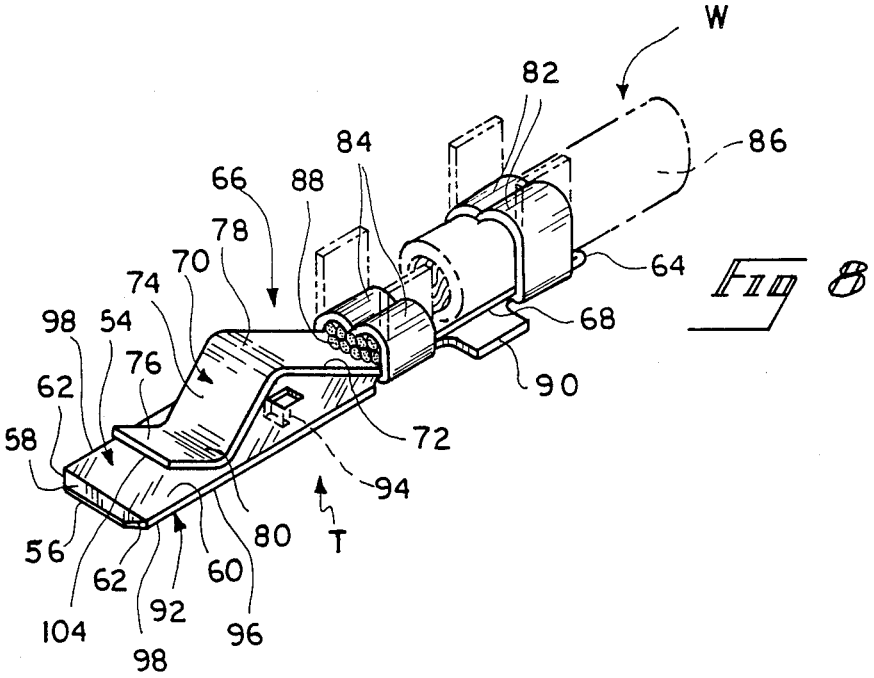
FIG. 8 is an enlarged perspective view of a conductor and terminal as used with the connector of the invention.

As shown in most clearly in FIG. 8, the rear portion of the primary blade 54, juxtaposed the rear portion 68 of the secondary blade 66, is provided with two pairs of crimp ears 82 and 84 respectively extending, in a slightly inwardly disposed manner, from the lateral edges 98 of the primary blade 54. The rearmost ears 82 are adapted to be crimped about the insulation 86 of a cable or wire conductor W while the forward ears 84 are crimped about the exposed, stripped conductor wires 88.

Intermediate the two pairs of crimp lugs 82,84 are a pair of laterally projecting tangs 90,90 which define a width slightly greater than that of the lateral edges 98 of the primary blade forward portion 92. Completing the major features of the terminal T is an integral catch or lug 94 struck from the primary blade 54 and which extends normal from the lower surface 96 thereof, along its centerline.

With the foregoing in mind, it will be appreciated that connectors according to the instant invention may be constructed with any suitable number of rows of passageways 20 each having one of the shelves 38 and the user may then insert the desired number of terminals T within selected ones of the available passageways as will be described hereinafter. FIGS. 1–4 and 7 depict connectors C presenting a single row of passageways 20 while FIGS. 5–6 illustrate an embodiment wherein the connectors D are provided with two stacked rows of passageways 20. Quite obviously, for any one connector assembly A, two identical, inverted connectors will be employed.

The attachment of a conductor and terminal such as shown in FIG. 8 is accomplished by guiding the nose 56 of the primary blade 54 into the rear opening of the desired passageway 20, with the lower surface 96 of the blade juxtaposed the passageway first horizontal wall 26. The blade lateral edges 98 define a blade width no greater than the lateral extent between the two vertical passageway side walls 24,24 while the two lateral tangs 90,90 are of a greater width and thus must be guided within the two lateral slots 30,30 formed in the vertical, side walls 24,24. The axial alignment provided by the engagement of the tangs within these slots maintains proper support and guidance of the terminal as it is urged forwardly, with the spring arm 70 entering the compartment or front passageway portion 36 adjacent the inner surface 44 of the related shelf 38. The terminal T becomes captively retained within the connector when it is pushed forwardly until the terminal blade lug 94, which has freely passed through the slot 32, has deflected and overridden the connector lock finger 50 to the position as shown in FIG. 7. The locked terminals T are limited from any substantial further forward displacement due to the termination of the tang slots 30 at a forward point vertically aligned with the front wall 100 of the passageway rear portion 34.

With opposed pairs of terminals T thusly mounted, such as within the two connectors C,C as shown in FIG. 7, it will be understood that before the joining of the two connectors, each primary blade 54 will have its nose 56 slightly spaced from the horizontal face 102 adjacent the nose 40 of its associated shelf 38. The terminal tangs 90 and the secondary blade spring arm 70 serve to maintain this disposition of the primary blade nose 56. Before the joining of two connectors C, the spring arm outer bend 78 will be seen to be juxtaposed the opposed inner shelf surface 44 while the spring arm free end 104 is well spaced from this shelf surface and the spring arm inner bend 80 is juxtaposed the primary blade upper surface 60. With this construction, as two such terminal-equipped connectors C,C are joined as in FIG. 7, the relatively opposed and inverted primary blade noses 56,56 override each other, with the assistance of the bevels 58,58. continued inward displacement of the two connectors forces each primary blade nose 56 to cam apart the spring arm inner bend 80 of the cooperating terminal such that a sandwiched effect is achieved with both primary blades being biased together between the pair of spring arms. The biasing force exerted by the spring arms is enhanced in view of the steeper inclination of the short offset portion 72 versus the lesser inclination of the longer offset portion 74. This minimizes deflection of the portion 72 thereby concentrating the biasing forces in the inner bend 80.

Orientation and alignment means are provided on each connector to facilitate the proper and accurate juncture between any two matching connectors C or D. As shown most clearly in FIGS. 1, 5 and 6, a pair of laterally spaced apart long, top tongues 106,106 axially project from the connector top wall 14, respectively flush with each side wall 10 and 12 while a pair of shorter, spaced apart bottom tongues 108,108 axially project from the connector bottom wall 16. The outer edges 110 of these latter tongues 108 will be seen to be spaced inwardly, the thickness of the connector side walls 10 and 12. With the above construction in mind, it will be understood that positive means are provided to insure accurate vertical orientation between two such connectors being joined, as the respective pairs of top tongues 106 slidably engage and overlie the bottom tongues 108.

Lateral or horizontal alignment is provided by lock and catch means respectively disposed intermediate the two pairs of tongues 106 and 108. A lock tab 112 is disposed within a cut-out formed in the medial portion of each top wall 14 and as shown in FIGS. 1 and 6–7, comprises a cantilever member attached at its rear 114 to the connector body and having a vertically deflectable forward nose 116 provided with a top mounted lock ramp 118. The tab nose 116 projects forwardly the same distance as the two adjacent longer tongues 106 and is adapted to be inserted beneath a catch member 120 elevated above the plane of each connector bottom wall 16. An opening in the catch member forms a socket or catch 122 so that when two similar connectors are fully joined, the lock ramp 118 of the two tabs 112 are snap-fitted within the sockets 122 of the cooperating catch members 120. When thusly joined, the front edges 22 of the two connector side walls 10,12 are in abutment and a rigid assembly A is provided with positive electrical continuity being assured through the engaged conductor terminals T. When the connector includes two or more rows of passageways 20 and related shelves 38, these shelves also provide a degree of orientation between two such connectors, in view of the intermeshing thereof when joined.

Quick and easy separation of two joined connectors is readily achieved by grasping each connector between the thumb and a finger of each hand and then simultaneously depressing the two elevated release pads 124 on the lock tabs 112 to disengage the lock ramps 118 from the opposed catch member sockets 122. Then, a simple pulling action will separate the two connectors.

It is to be understood that the present invention is not limited to the sole embodiment described above, but encompasses any and all embodiments within the scope of the following claims.

We claim:

1. A hermaphroditic connector for electrical conductors having a terminal affixed thereto, said terminal including a blade having lateral tangs, a lock lug and an overlying spring arm, comprising;

a connector housing having a front and rear and top, bottom and side walls, a row of laterally adjacent conductor passageways axially extending from said rear to said front, a plurality of peripheral walls defining a rear portion of each said passageway, a transversely disposed shelf extending forwardly of all of said passageway rear portions of said row and having an inner surface substantially axially aligned with said passageway rear portions, axially extending ridges normal to said shelf inner surface defining therebetween passageway front portions aligned with said rear portions, axially extending grooves in two of said passageway walls defining each said rear passageway portion adapted to receive said pair of lateral tangs on one said terminal, an axially extending slot in another one said passageway rear portion wall adapted to receive said terminal lock lug, deflectable lock means aligned with each said slot intermediate said passageway rear and front portions and adapted to snap-lock with said terminal lug within any one said passageway when said terminal spring arm is disposed within said passageway front portion adjacent said shelf inner surface.

a nose on said shelf defining the forwardmost portion thereof, whereby said terminal when locked within said housing is positioned with said spring arm masked behind said nose and said blade spaced from said nose to receive therebetween a blade from an opposed inverted similar connector housing and terminal, alignment means on said top and bottom walls projecting from said housing front, and lock and catch means on said housing top and bottom walls adapted to engage each other when two opposed inverted said connector housings are joined with said sides walls in juxtaposition.

2. A connector according to claim 1 wherein, said alignment means includes a pair of spaced apart tongues, and said tongues on said top and bottom walls of one said connector housing respectively slidably engaging said tongues on said bottom and top walls of another said connector housing as said housings are joined together.

3. A connector according to claim 1 wherein, said connector housing includes a plurality of said rows with said passageways thereof respectively vertically aligned.

4. A connector according to claim 1 wherein, said connector housing is of molded, one-piece construction.

5. A connector according to claim 1 wherein, said terminal spring arm includes a plurality of angularly offset portions with intermediate inner and outer bends, said terminal when locked within said housing having said outer bend juxtaposed said shelf inner surface with said inner bend juxtaposed said terminal blade.

6. A connector according to claim 1 wherein, said terminal lateral tangs define a width greater than that of said blade.

7. A connector according to claim 1 wherein, each said terminal blade includes a forward nose and an upper surface opposed to said spring arm, and a bevel on said blade forward nose communicating with said upper surface, whereby upon joining two relatively inverted ones of said connector housings having said terminals locked therein, opposed ones of said blade bevels engage one another to insure guidance of each said blade intermediate said blade and spring arm of the opposed ones of said terminals.

8. A connector according to claim 1 wherein, said lock means includes a deflectable tab having a lock ramp adjacent said alignment means, said tab having a nose disposed in a plane forward of said shelf, and said catch means including a catch member having a socket adjacent said alignment means, whereby said tab lock ramp tab of one said housing snap-fittingly engages within said catch member socket of another said housing when joined together.

9. A connector according to claim 1 wherein, said housing side walls include a substantially vertical front edge, and said shelf nose projecting forwardly of said housing side wall front edges.

10. A connector according to claim 9 wherein, said housing includes a plurality of said rows and shelves, whereby upon joining of two said housings said plurality of shelves on both said housings are slidably juxtaposed one another.

* * * * *